US011439182B1

(12) United States Patent
Wang

(10) Patent No.: US 11,439,182 B1
(45) Date of Patent: Sep. 13, 2022

(54) ATOMIZER CORE AND ITS MANUFACTURING METHOD, AND ATOMIZER

(71) Applicant: Dongguan Shikai Technology Co., Ltd., Dongguan (CN)

(72) Inventor: Shenyi Wang, Shenzhen (CN)

( * ) Notice: Subject to any disclaimer, the term of this patent is extended or adjusted under 35 U.S.C. 154(b) by 0 days.

(21) Appl. No.: 17/563,975

(22) Filed: Dec. 28, 2021

(30) Foreign Application Priority Data

Nov. 22, 2021 (CN) ..... 202111388382.6

(51) Int. Cl.

| | |
|---|---|
| ***A24F 40/10*** | (2020.01) |
| ***A24F 40/42*** | (2020.01) |
| ***A24F 40/46*** | (2020.01) |
| ***H05B 3/18*** | (2006.01) |
| ***A24F 40/44*** | (2020.01) |

(52) U.S. Cl.
CPC ..... *A24F 40/10* (2020.01); *A24F 40/42* (2020.01); *A24F 40/44* (2020.01); *A24F 40/46* (2020.01); *H05B 3/18* (2013.01); *H05B 2203/016* (2013.01); *H05B 2203/021* (2013.01)

(58) Field of Classification Search
CPC ..... A24F 40/10; A24F 40/42; A24F 40/44; A24F 40/46; A24F 47/008; H05B 3/18; H05B 3/34; H05B 3/54; H05B 2203/016; H05B 2203/021; A61M 11/042; A61M 11/041; A61M 15/06; A61M 2205/8206; G05D 23/2401
See application file for complete search history.

(56) References Cited

U.S. PATENT DOCUMENTS

| | | | | |
|---|---|---|---|---|
| 2017/0354184 | A1* | 12/2017 | Mironov | A24F 40/485 |
| 2019/0208821 | A1* | 7/2019 | Fraser | A61M 11/042 |
| 2020/0077703 | A1* | 3/2020 | Monsalud, Jr | H05B 3/46 |
| 2021/0204609 | A1* | 7/2021 | Bilat | A24F 40/57 |
| 2021/0392956 | A1* | 12/2021 | Taurino | A24F 40/10 |

* cited by examiner

*Primary Examiner* — Shawntina T Fuqua
(74) *Attorney, Agent, or Firm* — Novoclaims Patent Services LLC; Mei Lin Wong

(57) ABSTRACT

An atomizer core includes a heating element made of a flat mesh structure, a fluid absorbing element evenly wrapping around an outer side of the heating element for storing fluid and delivering the fluid to the heating element, and two conductive wires electrically extended from two sides of the heating element respectively. The atomizer core not only provides a uniform heating ability and a stable operation but also enhance the atomization rate of the fluid to maintain the real and better smoking taste. The atomizer core has a prolonged service life span and an enlarged heating area to reduce the carbon deposits of the atomizer.

10 Claims, 9 Drawing Sheets

ATOMIZER CORE AND ITS MANUFACTURING METHOD, AND ATOMIZER

CROSS REFERENCE OF RELATED APPLICATION

This is a non-provisional application that claims priority under 35 U.S.C. 119 to Chinese application number CN 202111388382.6, filed Nov. 22, 2021. The afore-mentioned patent application is hereby incorporated by reference in its entirety.

BACKGROUND OF THE PRESENT INVENTION

Field of Invention

The present invention relates to an electronic cigarette, and more particularly to an atomizer core, an atomizer, and a manufacturing method for the electronic cigarette.

Description of Related Arts

An atomizer of a conventional electronic cigarette comprises a heating element, such as a heating coil, for heating and atomization. However, the heating element has several drawbacks including small heating area, low working efficiency, uneven heating ability, and unstable working state. Therefore, the heating element will cause different problems, such as carbon deposits, to reduce the service life span of the electronic cigarette. Furthermore, sizes of the atomized particles generated by the conventional electronic cigarette are uneven due to the uneven heating ability, such that the vape taste of the conventional electronic cigarette will be affected to cause bad user experience. Thus, due to the structural design defects of the conventional electronic cigarette, a problem of fluid leaking cannot be solved.

SUMMARY OF THE PRESENT INVENTION

The invention is advantageous in that it provides an atomizer core and its manufacturing method and an atomizer, wherein by improving the structural configuration of the atomizer core, the problems of low work efficiency, uneven heating, and unstable operation can be solved. By improving the structural configuration of the atomizer, the problems of bad smoking taste and fluid leakage can be solved. Therefore, the present invention has advantages of stable operation and maintain real and better smoking taste, so as to enhance the practical use of the present invention.

In order to achieve the above objects, the present invention comprises an atomizer core which comprises a heating element made of a flat mesh structure, a fluid absorbing element evenly wrapping around an outer side of the heating element for storing fluid and delivering the fluid to the heating element, and two conductive wires electrically extended from two sides of the heating element respectively.

Preferably, the heating element is made of conductive material, wherein the heating element is corroded or forged to form a film structure with a mesh structure, wherein the conductive wires are laser welded at the two sides of the heating element respectively.

Preferably, the fluid absorbing element is made of porous ceramic and has an airflow through hole formed along a central axis thereof, wherein the heating element is evenly surrounded by and embedded in an inner wall of the fluid absorbing element to form an integral structure.

Preferably, the fluid absorbing element is made of multiple layers of cotton and is evenly and overlappingly wrapped around an outer side of the heating element. The atomizer further comprises a fluid guiding member and a supporting member. The fluid absorbing element is sleeved and received in the fluid guiding member. The supporting member is provided at bottom sides of the fluid guiding member and the fluid absorbing element when the fluid absorbing element is received in the fluid guiding member. The supporting member has a vent tube coaxially extended at a center axis of the supporting member, a threaded through hole formed between an inner wall of the supporting member and the vent tube for the conductive wires passing through the threaded through slot, and a glue groove provided at an end of the threaded through slot for encapsulating the conductive wires.

The present invention further provides a manufacturing method of the atomizer core which comprises the following steps.

S200: Form the heating unit in a cylindrical shape in a mold and solidify porous ceramic raw materials to form the fluid absorbing element in a cylindrical shape via an injection mold process to embed the heating unit in the through hole of the fluid absorbing element.

S201: Treat the porous ceramic and the heating unit at a high temperature to form the atomizer core which is constructed to have the heating element embedded in the ceramic fluid absorbing element.

Preferably, the porosity of the porous ceramic is set in the range between 40% and 60%.

In accordance with another aspect of the invention, the present invention comprises a manufacturing method of the atomizer core which comprises the following steps.

S210: Form the heating unit in a cylindrical shape in a cylindrical mold by encircling a flat mesh heating element 101 around the cylindrical mold.

S211: overlap the multiple layers of cotton to form the fluid absorbing element and wrap the fluid absorbing element around the outer side of the heating element so as to form a cylindrical configuration.

S212: Form a tubular member, as the fluid guiding member, which is made of metal to have two opposite fluid guiding grooves formed at a sidewall of the tubular member corresponding to the fluid absorbing element, wherein each of the fluid guiding grooves has a downward opening. According to the principle of concentration and atomization equilibrium, it adapts to different concentrations of atomized fluid to meet the needs of atomized fluid supply. When the supply of a thicker atomized fluid is insufficient, a fluid guiding window is formed on the sidewall of the tubular member between the fluid guiding grooves to communicate with the fluid absorbing element so as to form the fluid guiding member.

S213: Form the supporting member by forming a tubular element which is made of plastic to have a center through slot as the vent tube, the threaded through hole between an inner wall of the tubular element, and the vent tube for the conductive wires passing through the threaded through slot, and a glue groove provided at an end of the threaded through slot for encapsulating the conductive wires.

S214: Place the heating element wrapped with the fluid absorbing element into the fluid guiding member, and pass the conductive wires of the heating element through the threaded through slot of the supporting member, then affix the fluid guiding member at the supporting element, and apply glue at the glue groove to seal the conductive wires at the threaded through slot so as to affix the heating element at the supporting member for forming the atomizer core.

In accordance with another aspect of the invention, the present invention comprises an atomizer which comprises an atomizer core made of porous ceramics, a fluid storage for storing fluid, wherein the atomizer core is disposed in the fluid storage, an inhaling mouthpiece coupled at a top side of the fluid storage, and an air flow passage formed between the inhaling mouthpiece and the atomizer core.

Preferably, the atomizer further comprises a base body coupled between the atomizer core and the fluid storage, wherein the atomizer core is sleeved in the base body. The inhaling mouthpiece is coupled at a top side of the base body, wherein one or more fluid inlets are provided at a sidewall of the base body corresponding to a bottom side of the fluid storage. A vent duct is provided at the base body along a center axis thereof. An electrode is provided at a bottom side of the base body, wherein the two conductive wires of the atomizer core are electrically connected to two ends of the electrode respectively.

Preferably, the atomizer further comprises a sealing element, such as transparent plastic or glass silica gel, sealed at the base body to form the fluid storage.

Preferably, the atomizer further comprises a second fluid absorbing element provided between the atomizer core and the base body, wherein the second fluid absorbing element is made of multiple layers of cotton and is overlappingly wrapped around an outer side of the atomizer core.

Preferably, the inhaling mouthpiece and the base body are coupled with each other via a lock structure of a threaded connection structure.

In accordance with another aspect of the invention, the present invention comprises an atomizer which comprises an atomizer core made of multiple layers of cotton, a fluid storage medium wrapping around an outer wall of the atomizer core, a tubular fluid retainer for the fluid storage medium being loaded therein, and two sealing elements, wherein top and bottom openings of the tubular fluid retainer are sealed by the sealing elements respectively to seal the atomizer core and fluid storage medium in the tubular fluid retainer. The atomizer further comprises a vent tube coupled at the top side of the atomizer core, wherein each of the sealing elements has a center through hole. The atomizer further comprises a battery, a controller, and an end cover are orderly and operatively arranged under the atomizer core. The inhaling mouthpiece and the end cover are press-fitted and tightly affixed at two ends of a housing to form an integrated atomizer.

Preferably, the fluid storage medium has a predetermined elasticity and is made of a material that can absorb fluid.

In accordance with another aspect of the invention, the present invention comprises an atomizer which comprises an atomizer core and a tubular casing provided between the atomizer core and the fluid storage. The atomizer core is sleeved within the casing. The second fluid absorbing element is provided between the atomizer core and the casing, wherein the second fluid absorbing element is wrapped around an outer side of the atomizer core. An air inlet is extended to a top side of the casing. The inhaling mouthpiece has an integrated mouthpiece cavity. The mouthpiece cavity, the atomizer core 400 and the bottom of the casing are sealed by the sealing element, such as silica gel, to form the fluid storage. The casing further has a plurality of fluid inlets spacedly formed at a sidewall of the casing. The battery, the controller, and the end cover are orderly and operatively arranged under the atomizer core. The fluid storage and the end cover are press-fitted and tightly affixed with two ends of the housing to form an integrated atomizer.

Preferably, the mouthpiece cavity is made of transparent material, such as transparent plastic or glass.

Compared to the conventional atomizer, the present invention provides the following advantages:

1. Since the heating element is constructed to have a mesh structure, the heating element provides a resistance via a plurality of connections of the mesh wires between the mesh holes. Compared to the conventional heating element which is made of a spiral wire, the heating element with the mesh structure of the present invention provides a larger heating area, a uniform heating ability, and a stable operation. The heating element of the present invention not only further reduces carbon deposits during the operation of the atomizer but also prolongs the service life span of the atomizer. The service life span of the heating element of the present invention is more than 4 times of that of the conventional heating element.

2. Since the heating speed of the heating element of the present invention is relatively fast, the instantaneous heating ability of the heating element of the present invention is better than that of the conventional heating element. Since the heating temperature of the heating element of the present invention can be fine-adjusted and the heating area of the heating element of the present invention can be enlarged, the sizes of the atomized particles of the fluid are fine and uniform comparing to the spiral wire type conventional heating element. Therefore, the heating element of the present invention can maintain real and better smoking taste to enhance the practical use of the present invention.

3. The structural configuration of the meshed atomizer is easy to assembly, easy to mass produce, and has low defect rate. It has wide application ranges and should not be limited for being used in the examples of the present invention, but can also be used in other fields of electronic atomization.

DETAILED DESCRIPTION OF THE PREFERRED EMBODIMENT

The following description in conjunction with the accompanying drawings is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Embodiment 1

Figure 1:
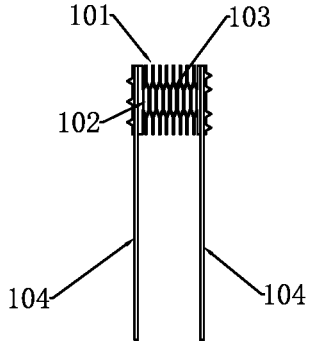
FIG. 1 is a schematic view of a first mode of a heating element of an atomizer according to a first embodiment of the present invention.
Figure 2:
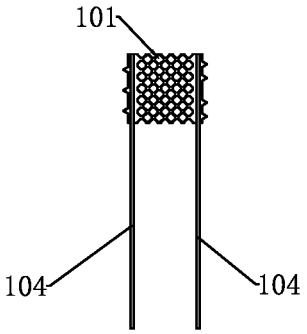
FIG. 2 is a schematic view of a second mode of the heating element of the atomizer according to the first embodiment of the present invention.
Figure 3:
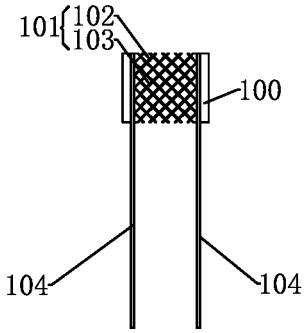
FIG. 3 is a schematic view of a third mode of the heating element of the atomizer according to the first embodiment of the present invention.
Figure 4:
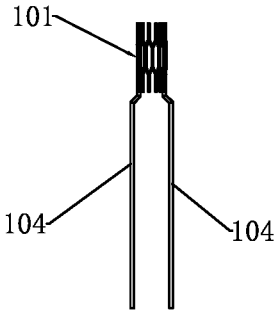
FIG. 4 is a schematic view of a fourth mode of the heating element of the atomizer according to the first embodiment of the present invention.

Referring to FIGS. 1 to 4 of the drawings, an atomizer according to a first embodiment of the present invention is illustrated, wherein the atomizer comprises a heating unit which is made of a nickel-chromium alloy sheet. The heating unit comprises a heating element 101 and two conductive wires 104 extended from two sides of the heating element 101 respectively. The heating element 101 is corroded or forged to form a film structure with a mesh structure at a middle portion. The conductive wires 104 are laser welded at the two sides of the mesh heating element 101 respectively. The heating element 101 is made of made of conductive material, such as flexible metal or alloy, wherein the heating element 101 is preferably made of nickel-chromium alloy mesh film. The mesh portion of the heating element 101 is constructed to have a plurality of mesh wires 103 interlaced with each other to define a plurality of mesh holes 102. A resistance is generated through a plurality of connections of the mesh wires 103 between the mesh holes 102, such that the heating unit is able to generate uniform heat during the operation of the atomizer so as to improve a stable and efficient heating ability. As shown in FIGS. 1 to 3, the mesh structure of the heating unit according to the first embodiment has various configurations. As shown in FIG. 4, the heating unit 101 can be rolled to have a cylindrical configuration. The atomizer according to the first embodiment further comprises an atomizer core which comprises a fluid adsorbing element 100, wherein the fluid adsorbing element 100 is evenly wrapped around the heating unit 101 for storing fluid and for delivering the fluid to the heating unit 101, such that the heating unit 101 is coaxially coupled within the fluid adsorbing element 100. The fluid is heated by the heating unit to a predetermined temperature to produce vapor particles, i.e. smoke. The conductive wires 104 are configured as two connectors for electrically connecting to electrodes of a power source respectively.

Embodiment 2

Figure 5:
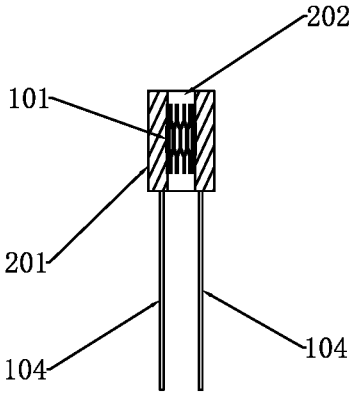
FIG. 5 is a schematic view of a first mode of a heating element of an atomizer according to a second embodiment of the present invention.
Figure 6:
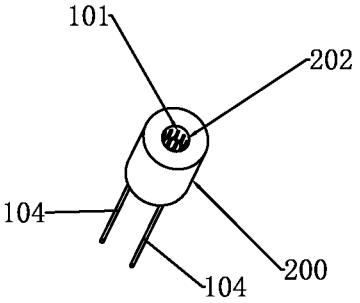
FIG. 6 is a schematic view of a second mode of the heating element of the atomizer according to the second embodiment of the present invention.
Figure 7:
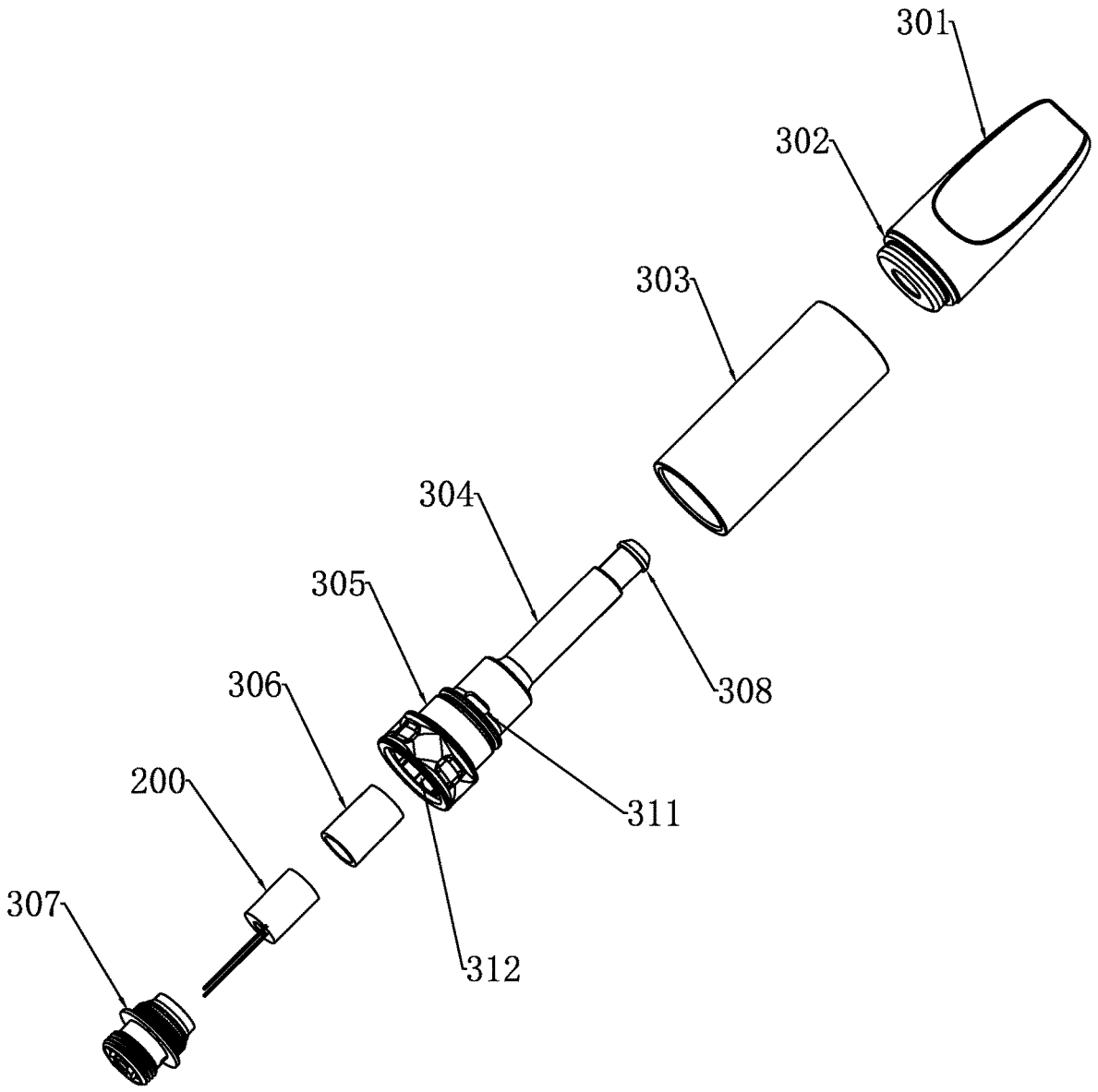
FIG. 7 is an exploded perspective view of an atomizer according to a third embodiment of the present invention.
Figure 8:
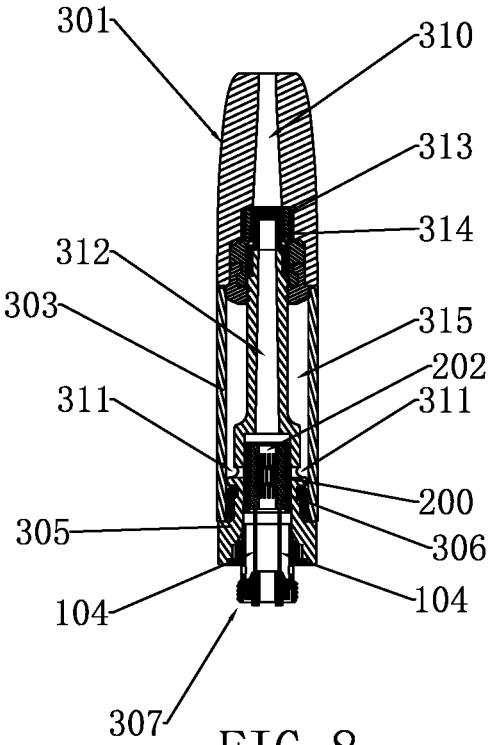
FIG. 8 is a first sectional view of the atomizer according to the third embodiment of the present invention.
Figure 9:
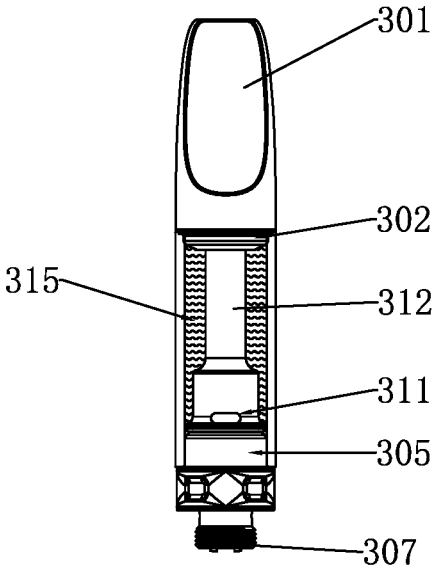
FIG. 9 is a second sectional view of the atomizer according to the third embodiment of the present invention.
Figure 10:
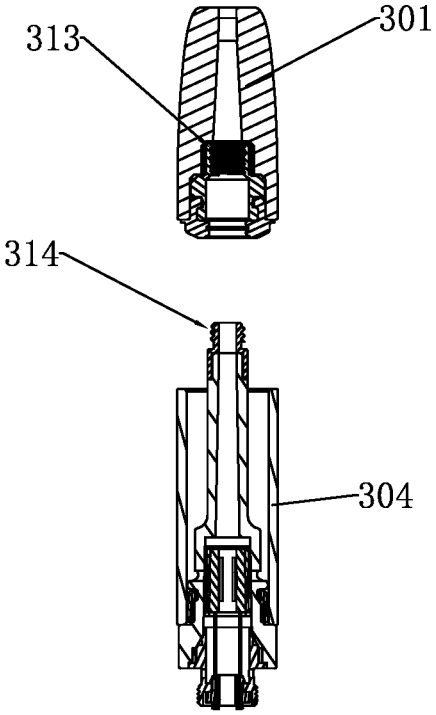
FIG. 10 is a first exploded sectional view of the atomizer according to the third embodiment of the present invention.
Figure 11:
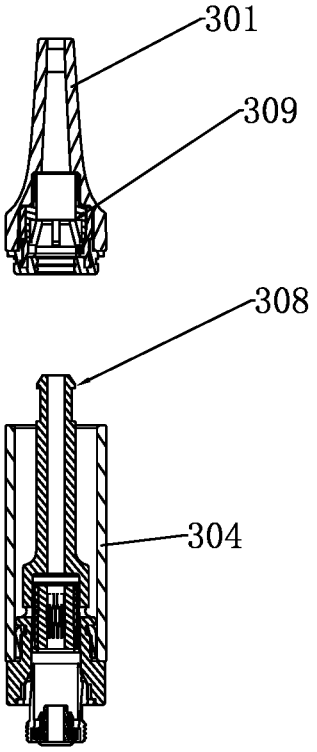
FIG. 11 is a second exploded sectional view of the atomizer according to the third embodiment of the present invention.
Figure 12:
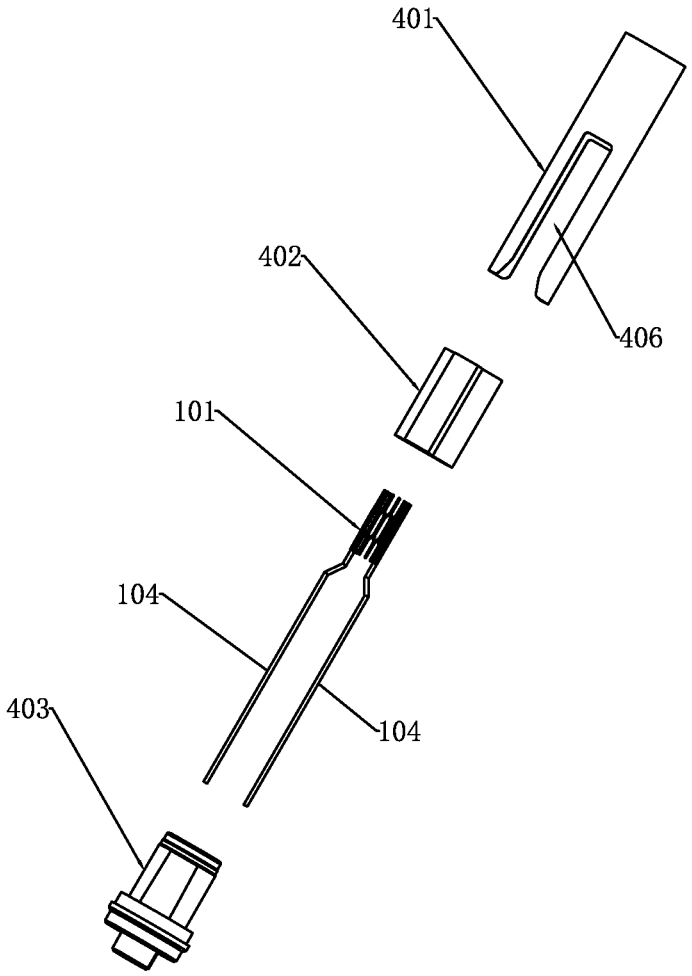
FIG. 12 is an exploded perspective view of an atomizer according to a fourth embodiment of the present invention.
Figure 13:
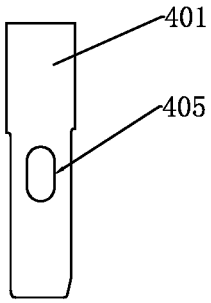
FIG. 13 is a schematic view of a fluid guiding unit of the atomizer according to the fourth embodiment of the present invention.
Figure 14:
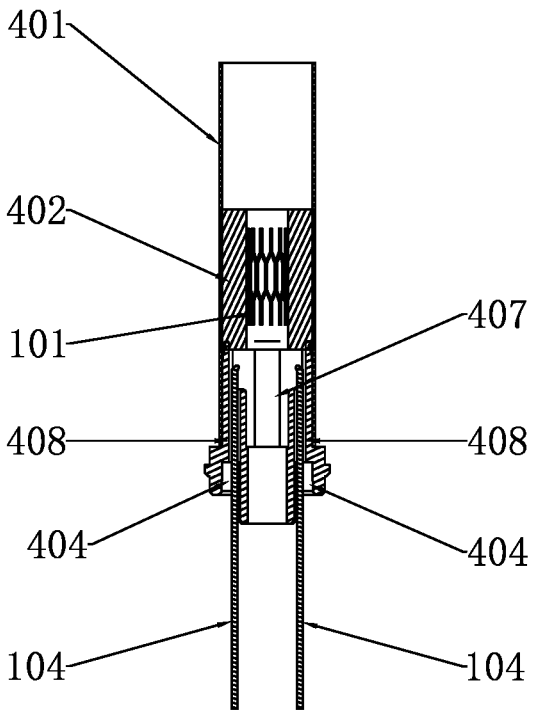
FIG. 14 is a sectional view of the atomizer according to the fourth embodiment of the present invention.
Figure 15:
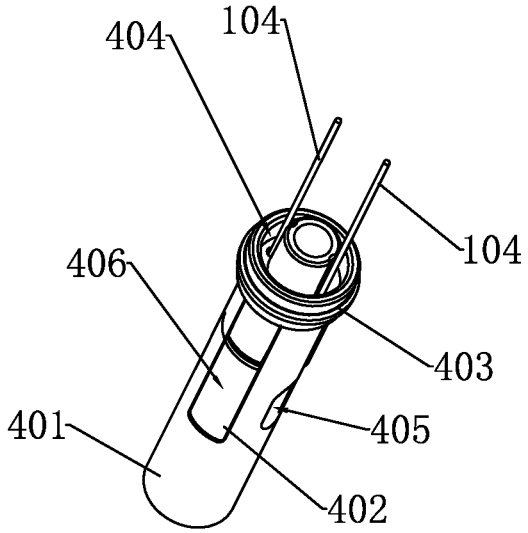
FIG. 15 is a perspective view of the atomizer according to the fourth embodiment of the present invention.

Referring to FIGS. 5 to 6, an atomizer core according to a second embodiment is illustrated as a modification, wherein the fluid absorbing element 201 is made of porous ceramic. The ceramic fluid absorbing element 201 has a center through hole, wherein the heating element 101 is evenly surrounded by and embedded in an inner wall of the fluid absorbing element 201 to form an integral structure. The center through hole of the fluid absorbing element 201 serves as an airflow through hole 202 defined along a central axis thereof.

The manufacturing method of the ceramic atomizer core 200 of the second embodiment comprises the following steps:

S200: Form the heating unit in a cylindrical shape in a mold, and inject and solidify porous ceramic raw materials to form the fluid absorbing element 201 in a cylindrical shape mold via an injection mold process to embed the heating unit 101 in the through hole of the fluid absorbing element 201.

S201: Treat the porous ceramic and the heating unit 101 at a high temperature to form the atomizer core which is constructed to have the heating element 101 embedded in the ceramic fluid absorbing element 201.

Preferably, the porosity of the porous ceramic of the second embodiment is set in the range between 40% and 60%. If the porosity is too high, the risk of fluid leakage will increase. If the porosity is too low, the fluid storage and delivery capacity will be insufficient to cause the smoke too dry or burning smell.

Embodiment 3

Referring to FIGS. 7 to 11 of the drawings, an atomizer according to a third embodiment is illustrated, wherein the atomizer is constructed to have the ceramic atomizer core 200 of the second embodiment and a fluid storage 315 for storing fluid to be atomized. The ceramic atomizer core 200 is disposed in the fluid storage 315. The atomizer further comprises an inhaling mouthpiece 301 provided at a top side of the fluid storage 315, and an air flow passage formed between the inhaling mouthpiece 301 and the atomizer core 200. The atomizer further comprises a base body 304 coupled between the atomizer core 200 and the fluid storage 315, wherein the atomizer core 200 is sleeved in the base body 304. The inhaling mouthpiece 301 is coupled at a top side of the base body 304, wherein one or more fluid inlets 311 are provided at a sidewall of the base body 304 corresponding to a bottom side of the fluid storage 315. A vent duct 312 is provided at the base body 304 along a center axis thereof. An electrode 307 is provided at a bottom side of the base body 304, wherein the two conductive wires 104 of the atomizer core 200 are electrically connected to two ends of the electrode 307 respectively. The inhaling mouthpiece 301 has an air inlet 310 extended along a center axis of the inhaling mouthpiece 301 to communicate with the vent duct 312 of the base body 304 and the airflow through hole 202 of the atomizer core 200 to form the air flow passage.

Furthermore, the atomizer further comprises a sealing element 305, such as transparent plastic or glass silica gel, sealed at the base body 304 to seal the fluid storage 315.

Furthermore, the atomizer further comprises a second fluid absorbing element 306 provided between the atomizer core 200 and the base body 304, wherein the second fluid absorbing element 306 is made of multiple layers of cotton and is overlappingly wrapped around an outer side of the atomizer core 200. The second liquid absorbing element 306 is configured to enhance the absorption and atomization speed and efficiency of the fluid in a balanced manner.

Preferably, according to the third embodiment, the atomizer further comprises a first fastener 309, such as a first buckle lock, provided at the bottom side of the inhaling mouthpiece 301 and a second fastener 308, such as a second buckle lock, provided at the top side of the base body 304, such that when the first fastener 309 and the second fastener 308 are fastened with each other, the inhaling mouthpiece 301 is permanently coupled at the base body 304, so as to provide a child protection function. Once the inhaling mouthpiece 301 is assembled, it cannot be dissembled from the base body 304. The assembling of the inhaling mouthpiece 301 is simple by inserting the top side of the base body 304 into the bottom side of the inhaling mouthpiece 301 until the first fastener 309 and the second fastener 308 are fastened with each other so as to provide a strong and safety lock structure between the inhaling mouthpiece 301 and the base body 304. It meets the child protection requirements of the European and American markets.

Alternatively, according to the third embodiment, the inhaling mouthpiece 301 has an internal thread 313 provided at the bottom side thereof, and correspondingly, the base body 304 has an external thread 314 provided at the top side thereof, wherein when the internal thread 313 and the external thread 314 are rotatably engaged with each other to form a threaded connection structure, the inhaling mouthpiece 301 is detachably and securely coupled with the base body 304, such that the inhaling mouthpiece 301 and the base body 304 can be easily assembled and dissembled.

According to the third embodiment, the atomizer further comprises a housing 303 having a tubular configuration enclosing the base body 304, wherein the base body 304 is preferably made of ceramic and the housing 303 is made of glass. The sealing element 305 is sealed between the base body 304 and the atomizer core 200 to isolate a connection between the base body 304 and the atomizer core 200. A second sealing element 302, such as silica gel, is provided and sealed between the base body 304 and the inhaling mouthpiece 301 to isolate a connection between the base body 304 and the inhaling mouthpiece 301. The fluid storage 315 is defined between the sealing element 305 and the second sealing element 302 and within the housing 303 to provide a fluid storage structure to solve the problem of excessive heavy metals, so as to provide an environmentally friendly, heath and safe product for the user. It is appreciated that the atomization process of the fluid in the fluid storage 315 can be seen through the housing to enhance the aesthetic appearance and operation of the atomizer.

Embodiment 4

Referring to FIGS. 12 to 15 of the drawings, an atomizer core according to a fourth embodiment is illustrated as another modification, wherein the fluid absorbing element 402 is made of multiple layers of cotton evenly and overlappingly wrapped around an outer side of the heating element 101. The atomizer further comprises a fluid guiding member 401 and a supporting member 403, wherein the fluid absorbing element 402 is sleeved and received in the fluid guiding member 401. The supporting member 403 is provided at bottom sides of the fluid guiding member 401 and the fluid absorbing element 402 when the fluid absorbing element 402 is received in the fluid guiding member 401. The supporting member 403 has a vent tube 407 coaxially extended at a center axis of the supporting member 403, a threaded through hole 408 formed between an inner wall of the supporting member 403 and the vent tube 407 for the conductive wires 104 passing through the threaded through slot 408, and a glue groove 404 provided at an end of the threaded through slot 408 for encapsulating the conductive wires 104.

The manufacturing method of the ceramic atomizer core of the fourth embodiment comprises the following steps.

S210: Form the heating unit in a cylindrical shape in a cylindrical mold by encircling a flat mesh heating element 101 around the cylindrical mold.

S211: overlap the multiple layers of cotton to form the fluid absorbing element 402 and wrap the fluid absorbing element 402 around the outer side of the heating element 101 so as to form a cylindrical configuration.

S212: Form a tubular member, as the fluid guiding member, which is made of metal to have two opposite fluid guiding grooves 406 formed at a sidewall of the tubular member corresponding to the fluid absorbing element, wherein each of the fluid guiding grooves 406 has a downward opening. According to the principle of concentration and atomization equilibrium, it adapts to different concentrations of atomized fluid to meet the needs of atomized fluid supply. When the supply of a thicker atomized fluid is insufficient, a fluid guiding window 405 is formed on the sidewall of the tubular member between the fluid guiding grooves 406 to communicate with the fluid absorbing element so as to form the fluid guiding member.

S213: Form the supporting member by forming a tubular element which is made of plastic to have a center through slot as the vent tube, the threaded through hole between an inner wall of the tubular element, and the vent tube for the conductive wires passing through the threaded through slot, and a glue groove provided at an end of the threaded through slot for encapsulating the conductive wires.

S214: Place the heating element wrapped with the fluid absorbing element into the fluid guiding member, and pass the conductive wires of the heating element through the threaded through slot of the supporting member, then affix the fluid guiding member at the supporting element, and apply glue at the glue groove to seal the conductive wires at the threaded through slot so as to affix the heating element at the supporting member for forming the atomizer core.

According to the fourth embodiment, the fluid guiding member is preferably made of metal to form a metal tube. When the concentration of the fluid is too high or the resistance of the heating element is too low, the fluid guiding window 405 can accelerate the delivery of the fluid so as to further enhance the practical use of the product.

According to the fourth embodiment, the fluid absorbing element is made of multiple layers of cotton, and the glue groove 404 is sealed with glue to affix the two conductive wires, such that the heating element will not be deformed or unintentional moved by external forces to affect the quality of the product.

Embodiment 5

Figure 16:
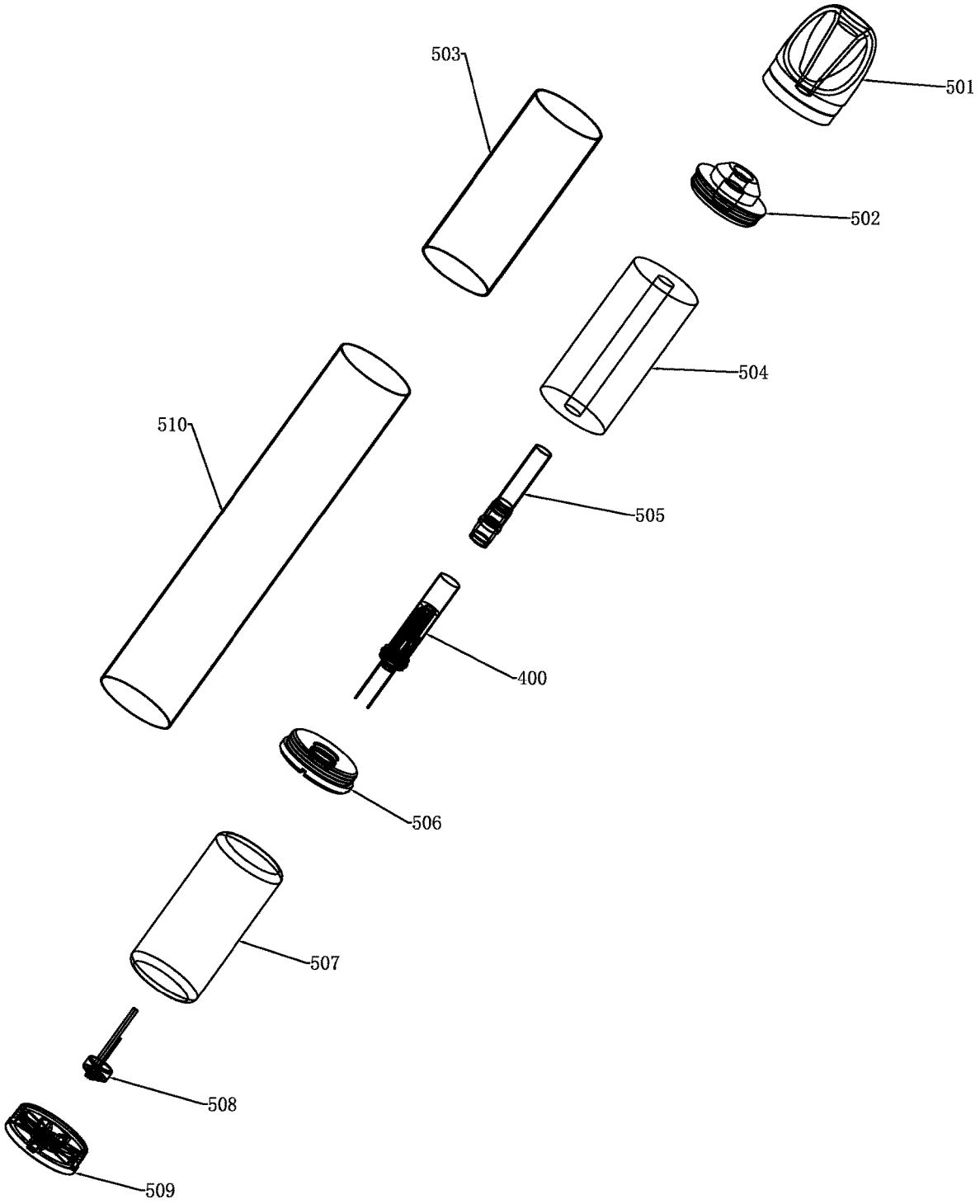
FIG. 16 is an exploded perspective view of an atomizer according to a fifth embodiment of the present invention.
Figure 17:
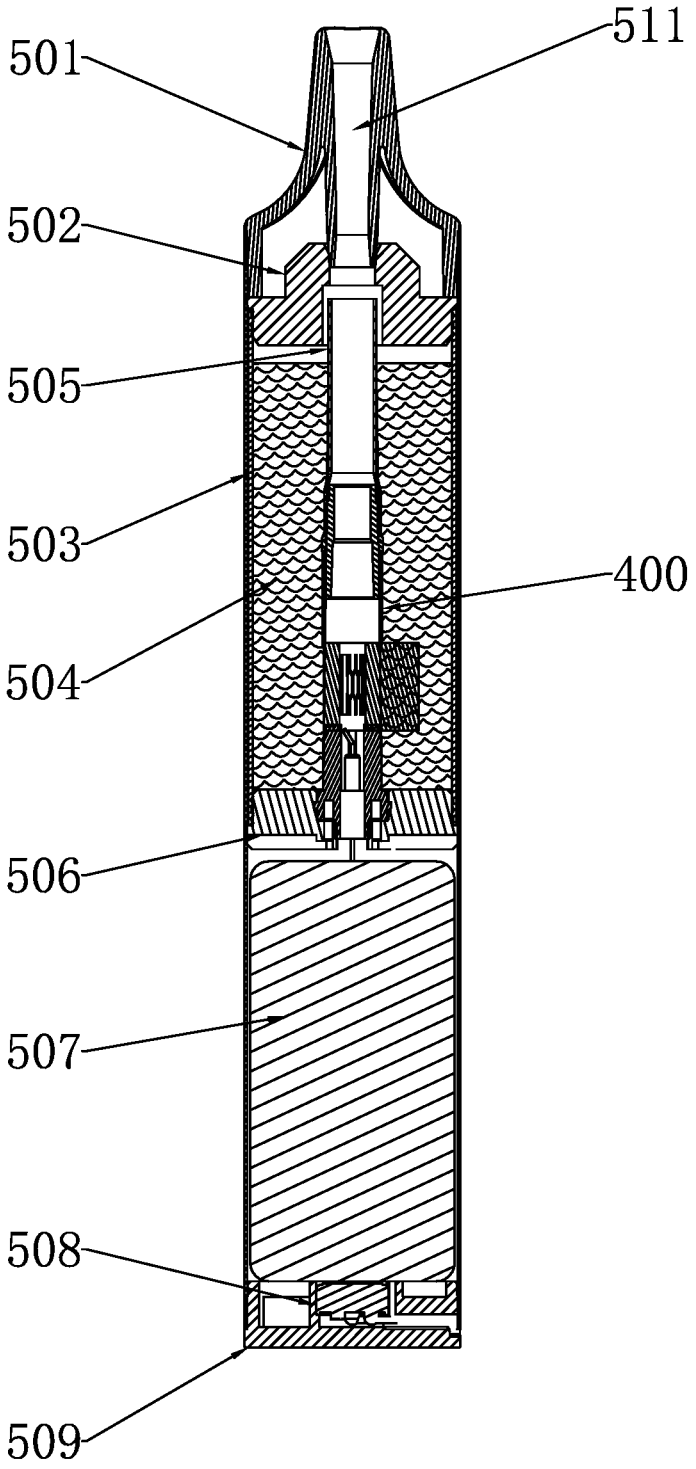
FIG. 17 is a sectional view of the atomizer according to the fifth embodiment of the present invention.

Referring to FIGS. 16 and 17 of the drawings, an atomizer according to a fifth embodiment is constructed to have the atomizer core 400 of the fourth embodiment, a fluid storage medium 504 wrapping around an outer wall of the atomizer core 400, a tubular fluid retainer 503 for the fluid storage medium 504 being loaded therein, and two sealing elements 502, 506, wherein top and bottom openings of the tubular fluid retainer 503 are sealed by the sealing elements 502, 506 respectively to seal the atomizer core 400 and the fluid storage medium 504 in the tubular fluid retainer 503. The atomizer further comprises a vent tube 505 coupled at the top side of the atomizer core 400 to communicate with the inhaling mouthpiece 501, wherein each of the sealing elements 502, 506 has a center through hole. The inhaling mouthpiece 501 is coupled on top of the fluid storage medium 504 and is coupled at one of the sealing elements 502, wherein the inhaling mouthpiece 501 has a center air inlet 511 coupled and sealed at the center through hole of the corresponding sealing element 502 to couple with the vent tube 505 while the conductive wires of the atomizer core 400 are sealed and extended through the center through hole of the another sealing element 506. The atomizer further comprises a battery 507, a controller 508, and an end cover 509 are orderly and operatively arranged under the atomizer core 400. The inhaling mouthpiece 501 and the end cover 509 are press-fitted and tightly affixed at two ends of a housing 510 to form an integrated atomizer.

Preferably, the fluid storage medium 504 has a predetermined elasticity and is made of a material that can absorb fluid, such as cotton, modified fibers, and polymer materials, which have strong fluid storage capacity and fluid delivering capacity. The fluid storage medium 504 can also guide the fluid to deliver to the fluid adsorbing element of the atomizer core in time for atomization, such that the atomizer of the present invention is hygienic, environmentally friendly, does not have any fluid leak problem, has good product stability and is easy to assemble.

Embodiment 6

Figure 18:
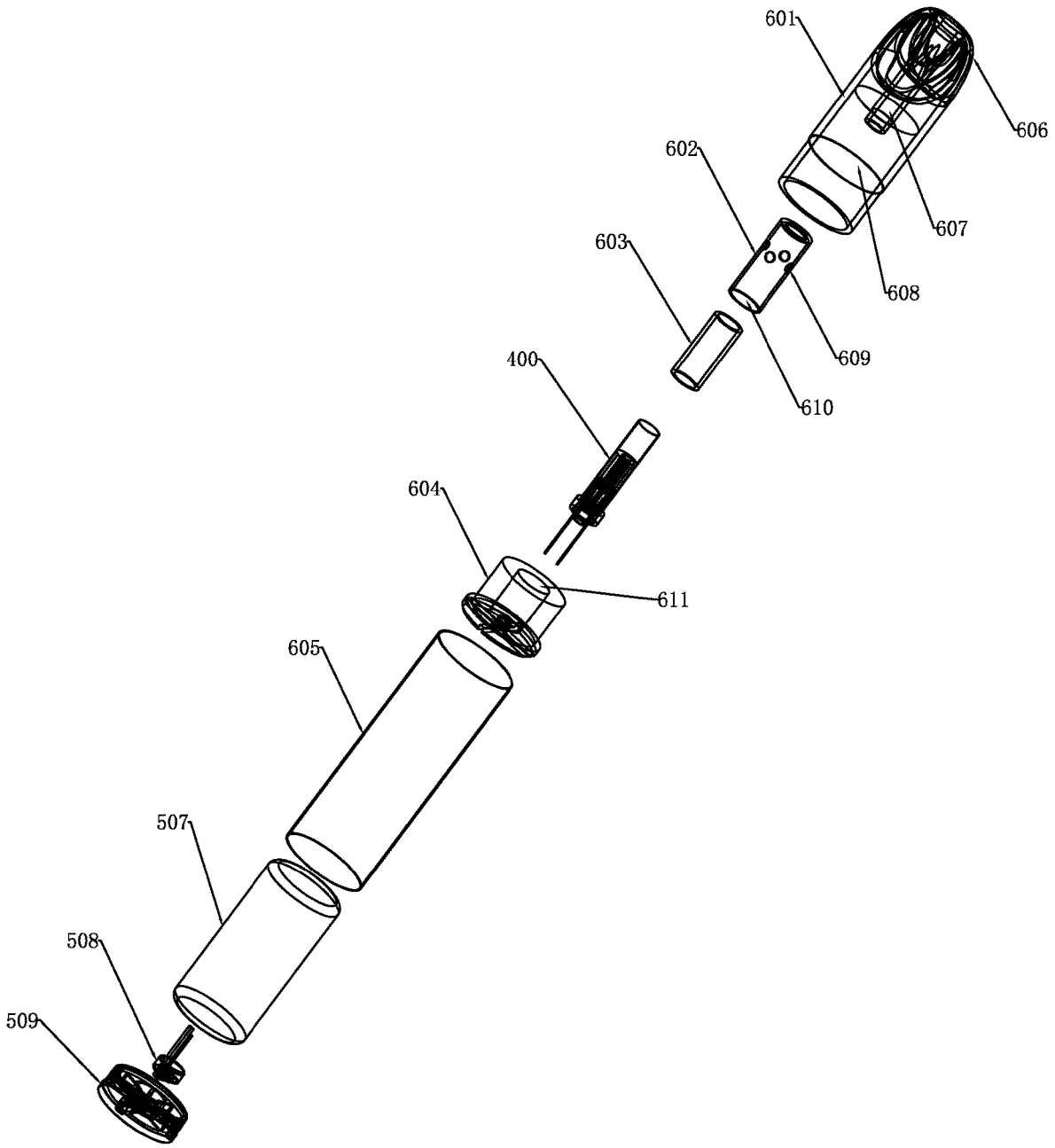
FIG. 18 is an exploded perspective view of an atomizer according to a sixth embodiment of the present invention.
Figure 19:
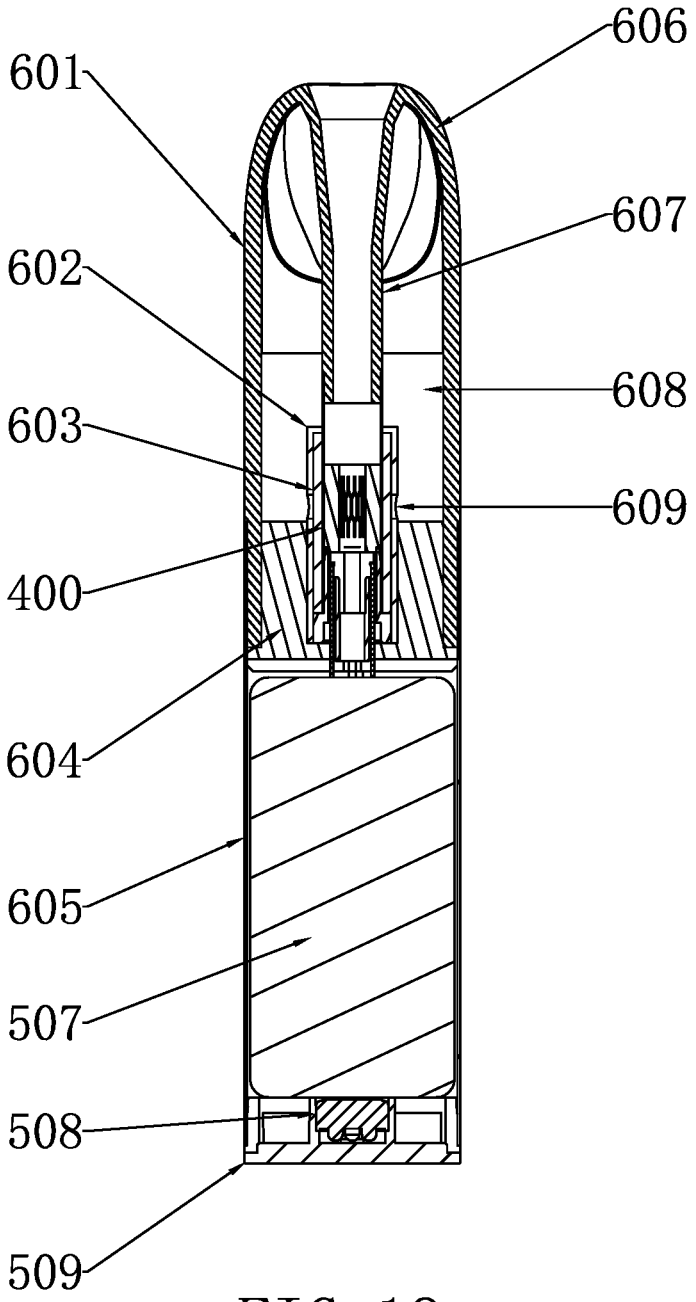
FIG. 19 is a sectional view of the atomizer according to the sixth embodiment of the present invention.

Referring to FIGS. 18 and 19 of the drawings, an atomizer according to a sixth embodiment is constructed to have the atomizer core 400 of the fourth embodiment, and a tubular casing 602 provided between the atomizer core 400 and the fluid storage 601. The casing 602 has a central through slot 610. The atomizer core 400 is sleeved within the casing 602 at the central through slot 610. The second fluid absorbing element 603 is provided between the atomizer core 400 and the casing 602, wherein the second fluid absorbing element 603 is wrapped around an outer side of the atomizer core 400. An air inlet 607 is extended to a top side of the casing 602. The inhaling mouthpiece 606 has an integrated mouthpiece cavity 608. The mouthpiece cavity 608, the atomizer core 400 and the bottom of the casing 602 are sealed by the sealing element 604, such as silica gel, to form the fluid storage 601. The sealing element 604 has an inner hole 611 for the bottom of the atomizer core 400 passing through. The casing 602 further has a plurality of fluid inlets 609 spacedly formed at a sidewall of the casing 602 to communicate with the second fluid absorbing element 603. The battery 507, the controller 508, and the end cover 509 are orderly and operatively arranged under the atomizer core 400. The fluid storage 601 and the end cover 509 are press-fitted and tightly affixed with two ends of the housing 605 to form an integrated atomizer.

Preferably, the mouthpiece cavity 608 of the inhaling mouthpiece 606 is made of transparent material, such as transparent plastic or glass. Therefore, the fluid storage can be seen through the atomizer and the consumption of the fluid can be observed at any time during use of the atomizer.

The present invention can serve as a disposable electronic cigarette atomizer, wherein in order to use the present invention, the atomizer core 400 can be installed in the casing 602 and the fluid can be directly stored in the fluid storage 601. Through the fluid inlets 609, the fluid inlets 609 are formed on the sidewall of the casing 602 and located at the bottom end of the liquid storage 601. The delivering speed of the fluid is controlled by the size of the fluid inlet 609. After filtering by the second fluid absorbing element 603, the fluid is guided to deliver to the atomizer core 400. Through these two isolation layering configurations and two fluid absorbing elements, the fluid in the fluid storage can be uniformly delivered to prevent any fluid leakage so as to enhance the stable operation of the atomizer and maintain the taste of the smoke. The shell of the fluid storage is preferably made of transparent material, such that the fluid and the consumption of the fluid can be seen directly during the operation, so as to enhance the aesthetic appearance of the present invention.

It is appreciated that the terms "first" and "second" in the above description are only used to distinguish one entity or operation from another entity or operation. Therefore, the above terms should not be an actual limitation for such actual relationship or order between these entities or operations. Furthermore, the terms "comprising", "having" or any other related terms are intended to include other elements not disclosed in the embodiments, such that the process, method, article or device including a series of elements not only includes those elements but also includes other elements that are not mentioned or listed in the present invention. If there are no further restrictions, the element defined by the sentence "comprising a . . . " does not exclude any existence of other identical elements in the process, method, article, or equipment.

One skilled in the art will understand that the embodiment of the present invention as shown in the drawings and described above is exemplary only and not intended to be limiting. Therefore, this invention includes all modifications encompassed within the spirit and scope of the following claims.

What is claimed is:

1. An atomizer, comprising:

a fluid storage for storing fluid to be atomized;

an atomizer core disposed in said fluid storage, wherein said atomizer core comprises a heating element having mesh structure, a fluid absorbing element evenly wrapping around said heating element delivering the fluid to said heating element, and two conductive wires electrically extended from two sides of said heating element respectively;

an inhaling mouthpiece coupled on top of said fluid storage, a fluid guiding member, wherein said fluid absorbing element is sleeved in said fluid guiding member; and a supporting member provided at bottom sides of said fluid guiding member and said fluid absorbing element when said fluid absorbing element is received in said fluid guiding member, wherein said supporting member has a vent tube coaxially extended at a center axis of said supporting member, a threaded through hole formed between an inner wall of said supporting member and said vent tube for said conductive wires passing through said threaded through slot, and a glue groove provided at an end of said threaded through slot for encapsulating said conductive wires when glue is applied at said glue groove, wherein said heating element is constructed to have a plurality of mesh wires interlaced with each other to define a plurality of mesh holes for enlarging a heating area to atomize the fluid so as to produce vapor particles, and said fluid absorbing element is made of multiple layers of cotton and is overlappingly wrapped around said atomizer core.

2. The atomizer, as recited in claim 1, wherein said fluid guiding member has two opposite fluid guiding grooves formed at a sidewall of said corresponding to said fluid absorbing element, and a fluid guiding window formed on said sidewall of said fluid guiding member between said fluid guiding grooves to communicate with said fluid absorbing element, wherein each of said fluid guiding grooves has a downward opening.

3. The atomizer, as recited in claim 1, further comprising:

a tubular fluid retainer, wherein said fluid storage is formed as a fluid storage medium being loaded in said tubular fluid retainer;

two sealing elements, wherein top and bottom openings of said tubular fluid retainer are sealed by said sealing elements respectively to seal said atomizer core and said fluid storage medium in said tubular fluid retainer; and a vent tube extended from said top side of the atomizer core to communicate with said inhaling mouthpiece through one of said sealing elements.

4. The atomizer, as recited in claim 3, wherein said fluid storage medium has a predetermined elasticity and is made of a material that is adapted to absorb the fluid.

5. The atomizer, as recited in claim 3, wherein each of said sealing members has a center through hole, wherein a center air inlet of said inhaling mouthpiece is coupled and sealed at said center through hole of one of said sealing element to couple with said vent tube, wherein said conductive wires of said atomizer core are sealed and extended through said center through hole of another said sealing element.

6. The atomizer, as recited in claim 3, further comprising a battery, a controller, and an end cover are orderly and operatively arranged under said atomizer core, wherein said inhaling mouthpiece and said end cover are press-fitted and tightly affixed at two ends of said housing to form an integrated atomizer.

7. The atomizer, as recited in claim 1, further comprising:

a tubular casing having a central through slot, wherein said atomizer core is sleeved within said casing at the central through slot thereof;

a second fluid absorbing element provided between said atomizer core and said casing at a position that said second fluid absorbing element is wrapped around said atomizer core; and a sealing element having an inner hole for a bottom of said atomizer core passing through, wherein a mouthpiece cavity of said inhaling mouthpiece, said atomizer core and said bottom of said casing are sealed by said sealing element.

8. The atomizer, as recited in claim 7, wherein said mouthpiece cavity of said inhaling mouthpiece is made of transparent material for enabling the fluid in said fluid storage to be seen through.

9. The atomizer, as recited in claim 7, wherein said casing has a plurality of fluid inlets spacedly formed at a sidewall of said casing to communicate with said second fluid absorbing element.

10. The atomizer, as recited in claim 7, further comprising a battery, a controller, and an end cover are orderly and operatively arranged under said atomizer core, wherein said inhaling mouthpiece and said end cover are press-fitted and tightly affixed at two ends of said housing to form an integrated atomizer.

* * * * *